US006309126B1

(12) United States Patent
Narula et al.

(10) Patent No.: US 6,309,126 B1
(45) Date of Patent: Oct. 30, 2001

(54) LOTION APPLICATION DEVICE

(76) Inventors: Dipak Narula, 910 Cherokee Rd., Louisville, KY (US) 40204; Vinod K. Narula, 9805 Silky Dogwood Ct., Louisville, KY (US) 40241

( * ) Notice: Subject to any disclaimer, the term of this patent is extended or adjusted under 35 U.S.C. 154(b) by 19 days.

(21) Appl. No.: 09/693,207

(22) Filed: Oct. 20, 2000

Related U.S. Application Data

(60) Provisional application No. 60/160,651, filed on Oct. 21, 1999.

(51) Int. Cl.[7] ..... B43K 5/00

(52) U.S. Cl. ..... 401/202; 401/131; 401/48; 206/361; 15/244.1

(58) Field of Search ..... 401/6, 88, 131, 401/48, 196, 202; 206/204, 77.1, 361, 152, 362.4, 485; 215/23.9, 23.91, 241, 252, 736; 15/244.1, 244.2

(56) References Cited

U.S. PATENT DOCUMENTS

| | | | | |
|---|---|---|---|---|
| 2,575,788 | * | 11/1951 | Bobrov | 401/131 |
| 4,091,493 | * | 5/1978 | Weiss | 401/131 |
| 4,571,769 | * | 2/1986 | Ford | 15/244.1 |
| 5,659,916 | * | 8/1997 | Beatty et al. | 15/244.2 |

* cited by examiner

*Primary Examiner*—David J. Walczak
(74) *Attorney, Agent, or Firm*—Joan L. Simunic; Middleton Reutlinger

(57) ABSTRACT

A lotion application device includes a protective shell, a rotatable plate that mounts onto the shell, and a sponge secured to the plate. The sponge can be exposed and used to apply lotions to the skin, or the sponge can be concealed so the device can be transported without risk of contamination or damage to the sponge.

5 Claims, 11 Drawing Sheets

LOTION APPLICATION DEVICE

CROSS-REFERENCE TO RELATED APPLICATION

This application claims priority from U.S. Provisional Application Ser. No. 60/160,651, filed Oct. 21, 1999, which application is incorporated herein by reference in its entirety.

BACKGROUND

The present invention relates to a device for applying lotions, creams or gels to the skin surface.

Lotion applicators for applying lotions to the skin are known in the prior art. These applicators are commonly used in conjunction with suntan lotion, liquid soaps, or ointments of similar viscosity, so the lotion can be applied to the skin without the user having to handle the lotion directly. As described in U.S. Pat. No. 4,299,005 (issued to Brown), U.S. Pat. No. 4,896,984 (issued to Evans), U.S. Pat. No. 5,341,538 (issued to Banome), and U.S. Pat. No. 4,171,171 (issued to Jones), the applicators typically include a body and an application sponge. The body may further include a reservoir for holding the lotion to be applied to the skin, such as described in U.S. Pat. No. 5,573,342, issued to Patalano. If the body includes a reservoir, holes or similar outlet ports are provided in the reservoir to allow the lotion to feed from the reservoir to the sponge.

One problem with the lotion applicators of the prior art is that the sponge remains exposed to the surroundings at all times, thus risking contamination of the sponge. Further, with the sponge exposed to the surroundings, it can be difficult to transport the lotion applicator, for example, to the beach, because of risk of damaging the sponge. Another problem with the lotion applicators of the prior art is that the lotion to be applied to the skin is supplied in one bottle and must then be transferred to the reservoir of the lotion applicator. This can be a messy operation and can leave the user's hands feeling sticky or greasy, which can be undesirable, such as when on the beach, or dangerous, such as when in a shower.

SUMMARY OF THE INVENTION

The present invention is a lotion application device that includes a protective shell and a sponge secured to a replaceable, rotatable plate that mounts onto the shell. The device has a closed position, in which the sponge is hidden within the shell, and an open position, in which the sponge is exposed to the surroundings. Because the plate can be rotated to hide the sponge within the shell, the risk of contamination of the sponge is reduced, and the sponge can be easily transported without risk of damaging the sponge.

In a preferred embodiment, the plate can further include a latching device that prevents the plate from rotating about its axis without the user releasing the latch.

In an alternative preferred embodiment, the lotion to be applied is encased within the sponge, eliminating the need for the lotion to be transferred to the sponge.

DETAILED DESCRIPTION OF THE PREFERRED EMBODIMENT

The lotion application device depicted in the various Figures is selected solely for the purposes of illustrating the invention. Other and different application devices may utilize the inventive features described herein as well.

Figure 1:
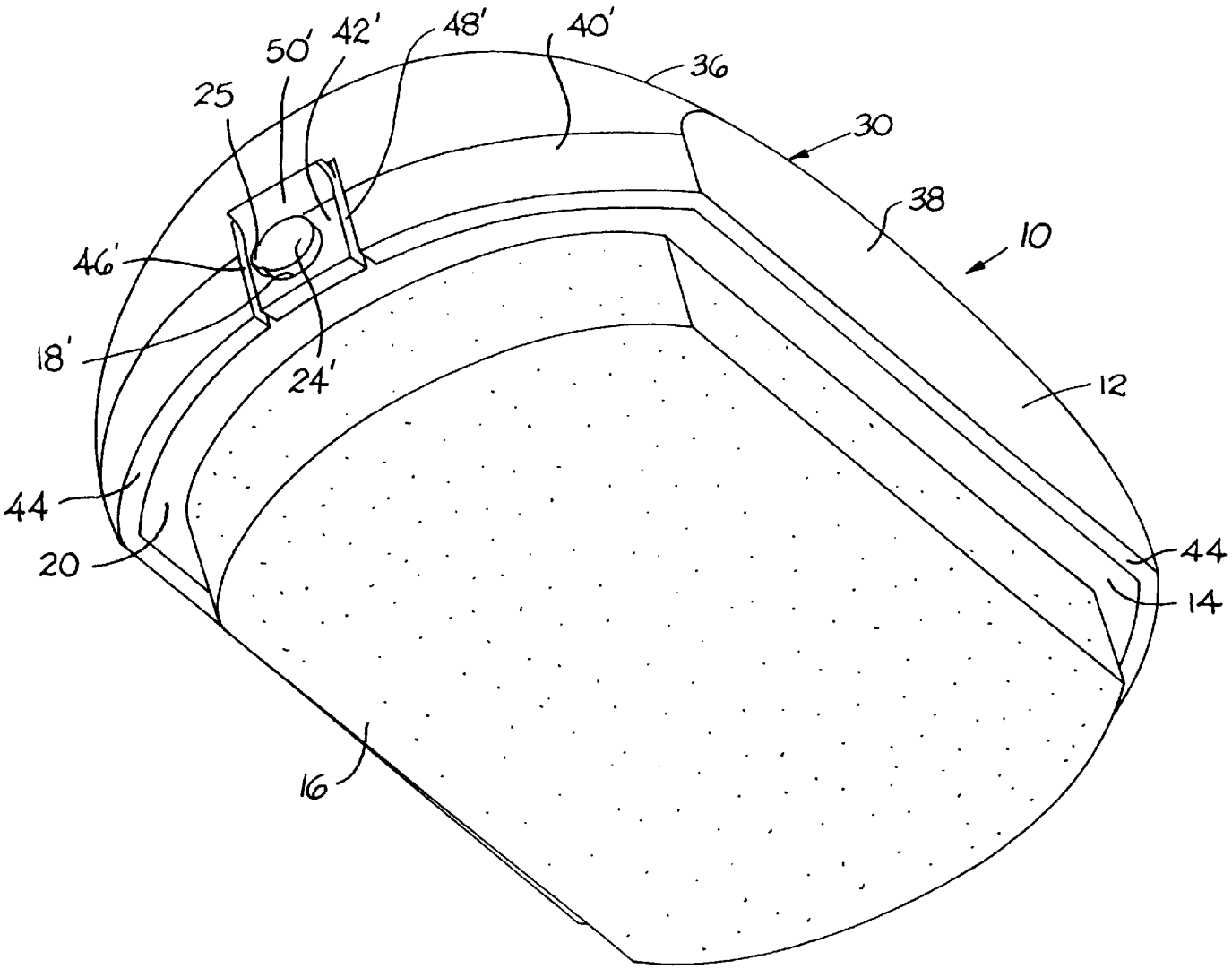
FIG. 1 is a perspective view of a lotion application device made in accordance with the present invention in the open position.
Figure 2:
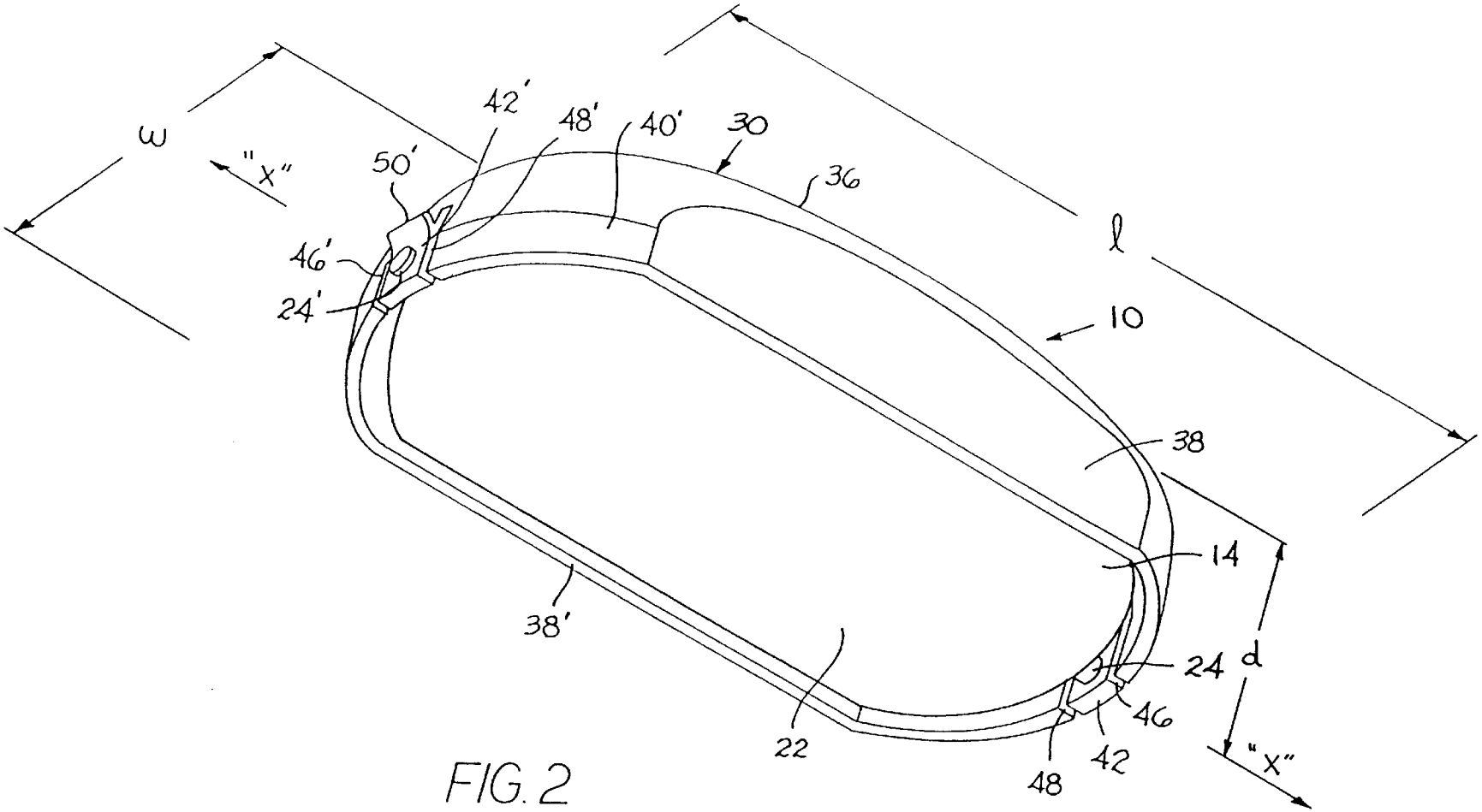
FIG. 2 is a perspective view of the device of FIG. 1 in the closed position.

Reference is first made to FIGS. 1 through 7 in which the device constructed in accordance with the present invention is generally noted by the character numeral 10. The device 10 has as major components a shell 12, a rotatable plate 14 which is mounted on the shell 12, and a sponge 16 which is attached to plate 14. The device 10 is designed to allow a user to expose the sponge 16 ("open position"), as shown in FIG. 1, or to conceal the sponge 16 ("closed position") exposing only the plate 14, as shown in FIG. 2. When the sponge 16 is exposed, it can be used to apply lotions, such as sunscreen, moisturizer, liquid soap, or other flowable products, to the skin. When the sponge 16 is concealed, the device 10 can be transported, for example taken to the beach, without risk of contamination or damage to the sponge 16.

Referring again to FIGS. 1 through 7, the shell 12 has a body 30 having a length "l", a width "w", and a depth at the deepest point "d". The body 30 has a top region 36, side walls 38, 38', end walls 40, 40', and tabs 42, 42', and defines an interior face 32 and an exterior face 34. The top 36 covers the sponge 16 when the applicator 10 is closed. The side walls 38, 38' extend downwardly lengthwise from the top 36, and the ends 40, 40' extend downwardly from the top 36 widthwise, with the side walls 38, 38' and ends 40, 40' terminating to form a lip 44, having a thickness "t". The thickness "t" of the lip 44 is preferably representative of the thickness of the shell 12, although the top 36 may be reinforced if desired. The side walls 38, 38' are fused to the ends 40, 40' where they juxtapose. The end 40 has a tab 42, which includes an aperture 18 positioned along a longitudinal axis "x". The tab 42 is formed by essentially parallel slits 46, 48 cut from the lip 44 toward the top 38. The slits 46, 48 are approximately equidistant and on opposite sides of the aperture 18, and are cut to approximately the same depth "s". An essentially identical tab 42' is formed by slits 46', 48' on end 40' and has an aperture 18' positioned along the axis "x". The shell 12 can have any shape that can include a top 36, side walls 38, 38', and ends 40, 40', such as a rectangular block shape, a curved ovoid shape, a hollow hemispherical shape, or the like. In the preferred embodiment, the shell 12 has a slightly curved shape for ease of handling by the user. The shell 12 can be made from any material which can be formed into the desired shape, but preferably is made from a semi-rigid plastic, such as polyethylene, polypropylene, high density linear polyethylene, polyvinyl chloride (PVC), polyethylene terephthalate (PET), amorphous polyethylene terephthalate (APET), high density polyethylene/ethylvinyl acetate (HDPE/EVA) copolymer, glycol-modified polyethylene terephthalate (PETG), acrylonitrile butadiene styrene (ABS), or combinations thereof, and is formed through a molding process.

Figure 3:
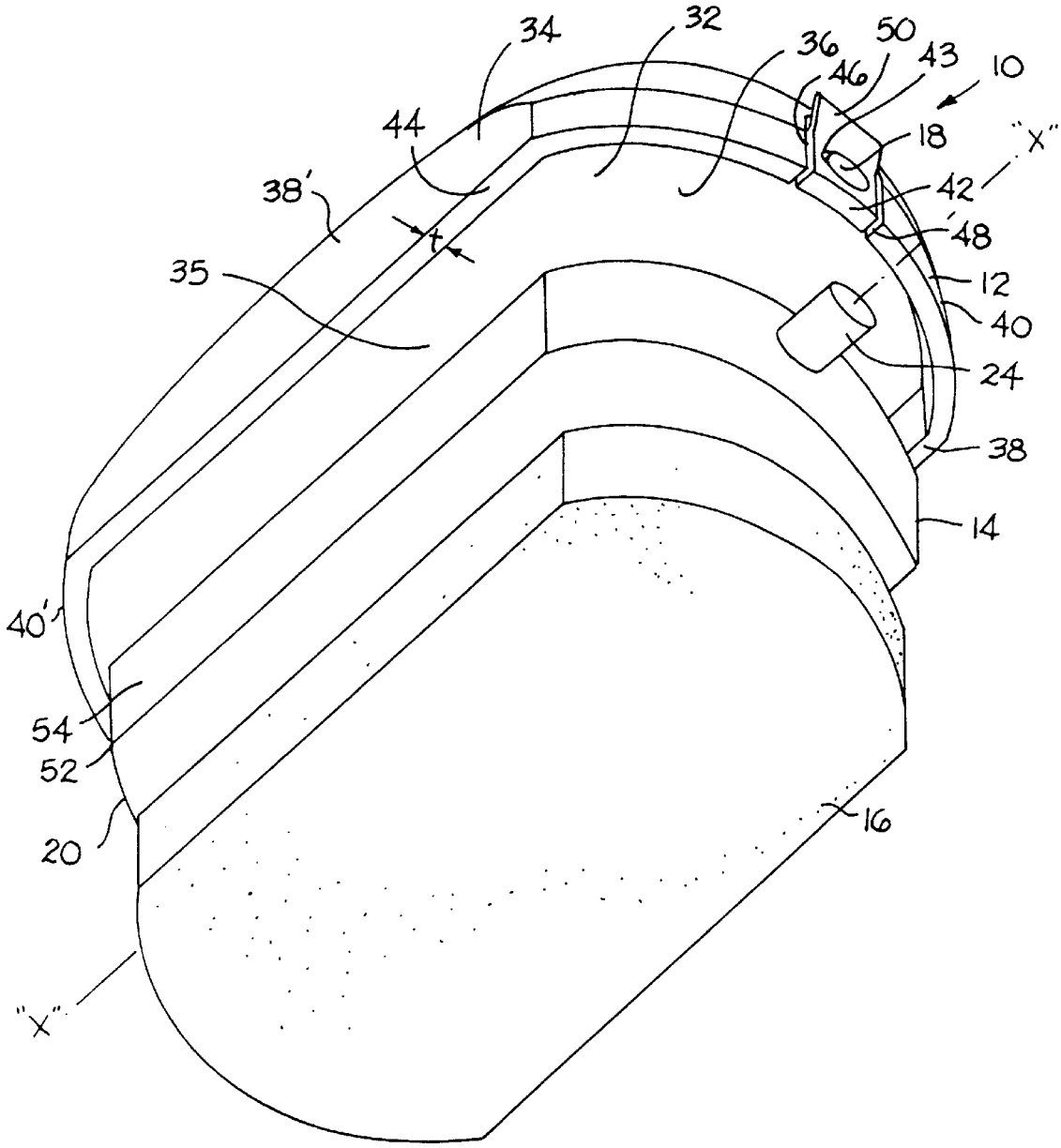
FIG. 3 is an exploded view of the device of FIG. 1.
Figure 6:
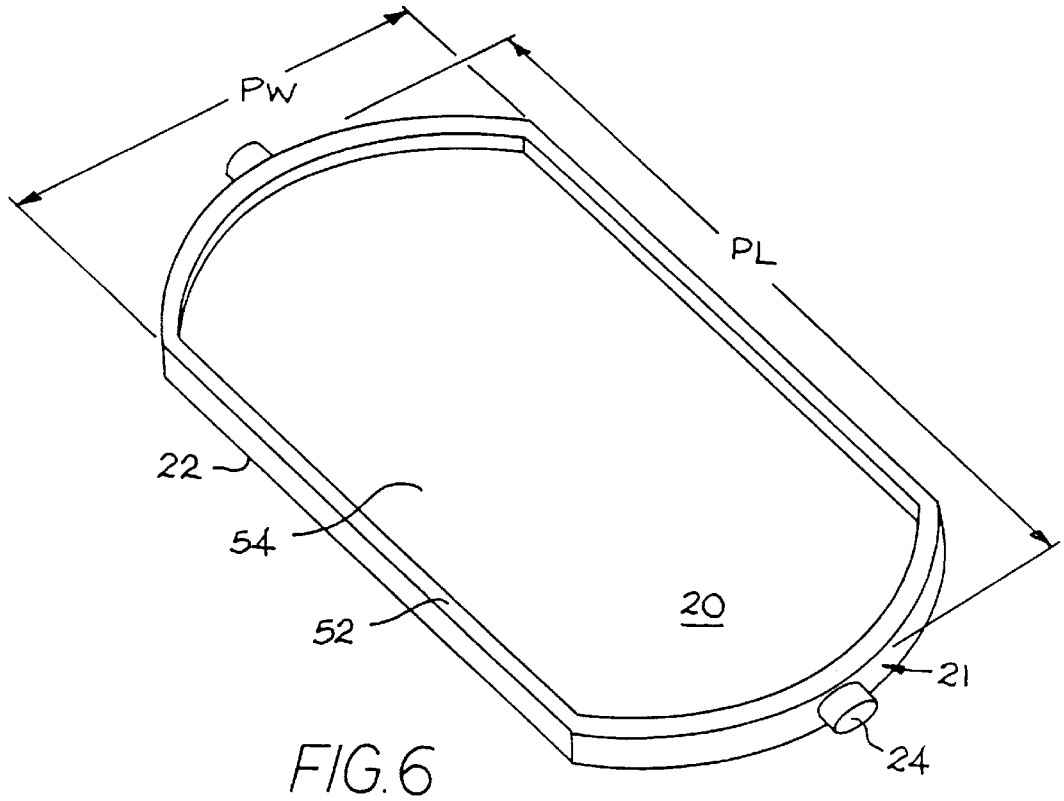
FIG. 6 is a bottom perspective view of the rotatable plate of the device of FIG. 1.

As shown in FIGS. 2, 3, and 6, the rotatable plate 14 is an essentially flat piece 21 having a length "pl" and a width "pw", and defining a front face 20 and a rear face 22. The front face 20 has an essentially flat center section 54 to which the sponge 16 can be attached. The flat center 54 may extend to the periphery of the front face 20, or an elevated edge 52 can optionally be included along the periphery of the face 20. The rear face 22 may be flat, as shown in FIG. 2, but other shapes are acceptable. The plate 14 further includes attachment pins 24, 24' that project from the piece 21. The pins 24, 24' must be long enough to project through the apertures 18, 18', respectively, to hold the plate 14 in the shell 12. With the pins 24, 24' projecting through the apertures 18, 18', the plate 14 can rotate about the axis "x" between the open position and the closed position. Preferably, the plate 14 can be easily removed from the shell 12 by lifting the tabs 42, 42' and releasing the pins 24, 24' from the apertures 18, 18'. This allows the user to exchange the plate 14 and sponge 16, if so desired. The plate 14 can be made from any material which can be formed into the desired shape, but preferably is made from a semi-rigid plastic, such as polyethylene, polypropylene, high density linear polyethylene, polyvinyl chloride (PVC), polyethylene terephthalate (PET), amorphous polyethylene terephthalate (APET), high density polyethylene/ethylvinyl acetate (HDPE/EVA) copolymer, glycol-modified polyethylene terephthalate (PETG), acrylonitrile butadiene styrene (ABS), or combinations thereof, and is formed through a molding process.

Figure 4:
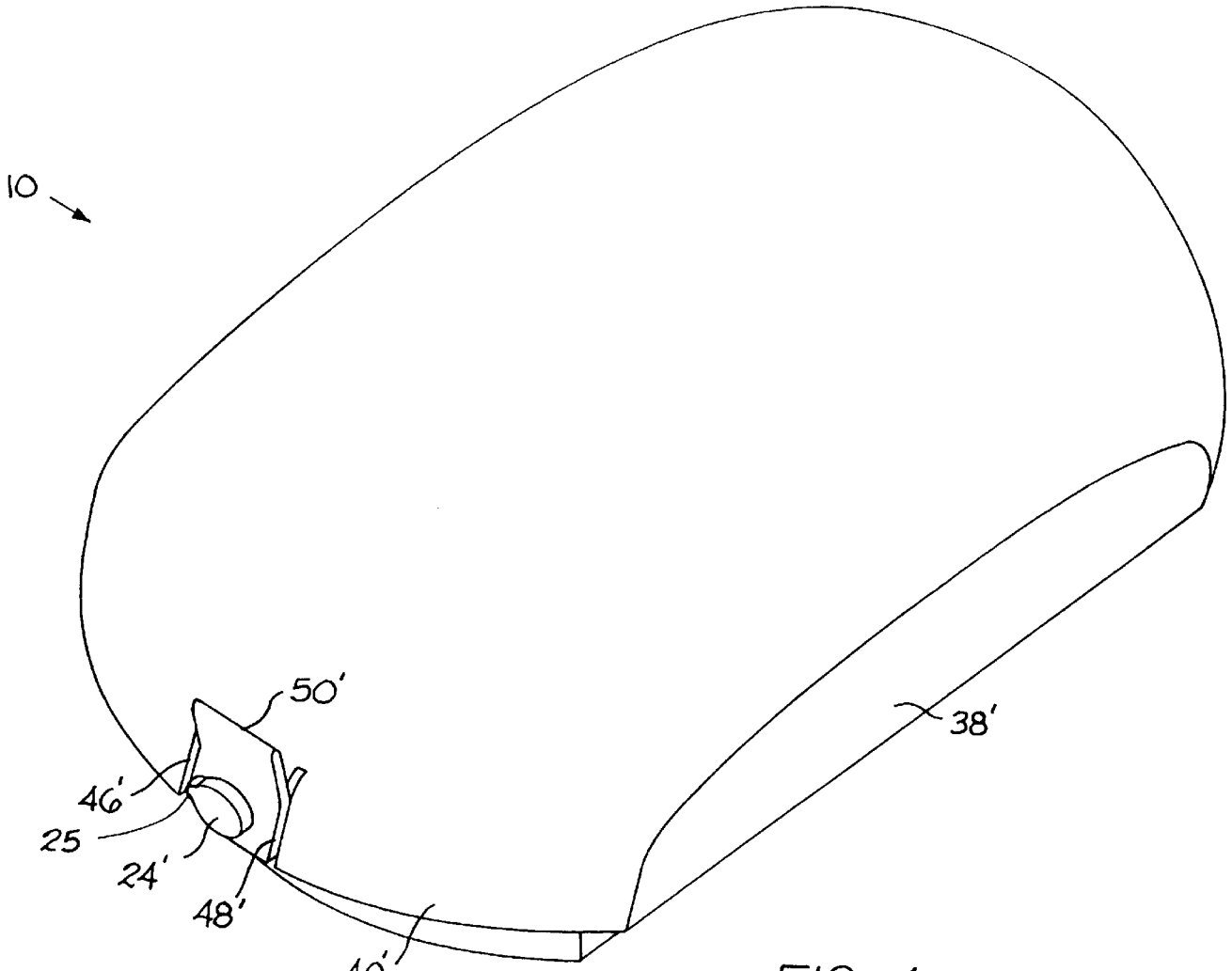
FIG. 4 is a top view of the device of FIG. 1.
Figure 5:
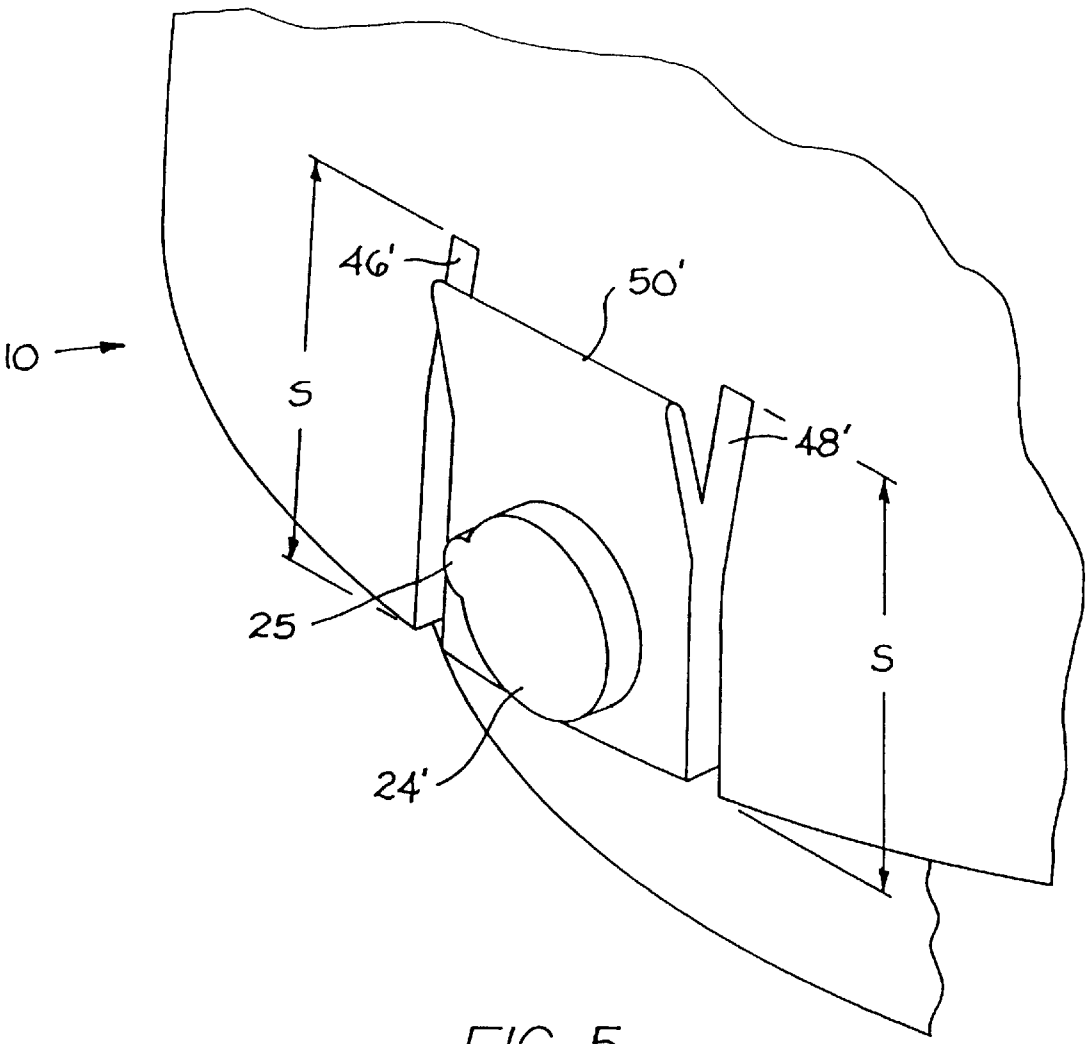
FIG. 5 is a view of the turning pin of the device of FIG. 1.

It may be advantageous to limit the rotation of the plate 14 within the shell 12 at certain times, such as when the device is in the open position or in the closed position. One way to limit the rotation is to provide a coordinating structure to "lock" the plate 14 in position relative to the shell 12. FIGS. 1, 4 and 5 show plate 14 with an optional thumb 25 protruding from the pin 24. The thumb 25 can cooperate with an optional notch 43 (not shown) scored into the exterior face of the tab 42 to keep the plate 14 from rotating between the opened and closed position without the user forcing the thumb 25 out of the notch 43. More than one notch 43 may be included on the tab 42 to allow the plate 14 to be locked into different positions.

Because the plate 14 is mounted within the shell 12 but is not permanently affixed to the shell 12, the plate 14 is preferably easily removable from the shell 12. As shown in FIGS. 1–6, the tab 42' can include an optional release 50', to assist the user in bending the tab 42' outward, thus releasing the pin 24' from the aperture 18'. An essentially identical release 50, and essentially identical notches 43 may be included on the tab 42. The release 50 allows for the tab 42 to be more easily lifted away from the plate 14, so the pins 24, 24' can be removed from the apertures 18, 18'. A new plate 14 can then be inserted into the shell 12.

Figure 7:
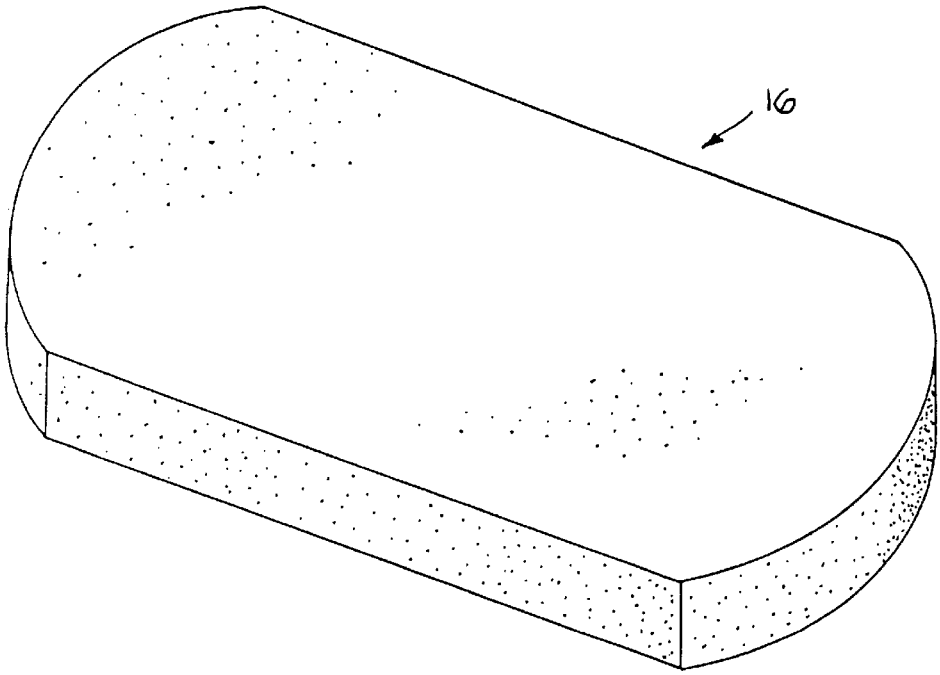
FIG. 7 is a bottom perspective view of the sponge of the device of FIG. 1.

The sponge 16, shown in FIGS. 1, 2 and 7, is attached onto the front face 20 of the plate 14. The sponge 16 is sized to allow the plate 14 to rotate along the axis "x" with the sponge 16 attached. The sponge 16 can be made from any foamed or felt material that can absorb or adsorb lotion, such as foamed polyurethane. A variety of glues or adhesives known in the art can be used to attach the sponge 16 to the plate 14. Optionally, the sponge 16 may include a cavity within the sponge 16 which can contain a lotion, gel, or cream, such as suntan lotion or liquid soap product, or the lotion can otherwise be impregnated into the sponge 16.

In a preferred embodiment, lotion application device 10 is constructed from a shell 12 made of high density polyethylene, a plate 14 made of high density polyethylene, and a sponge 16 made of polyurethane. The shell 12 has a length "l" of approximately 5", a width "w" of about 3½", and a depth "d" of about 1½" at the centermost point of the top region 36, and a lip 44, having a thickness "t" of about ⅛'. The shell 12 has a slightly curved shape, but the side walls 38, 38' are slightly flattened to allow for easier gripping by the user. End 40 includes slits 46, 48, each approximately ½" long ("s"). The slits 46, 48 are separated from each other by about ¾" to form a tab 42. Centered on the tab 42 is an aperture 18 of approximately ¼" diameter, and above the aperture essentially parallel to the lip 44 is a release 50 extending across the tab 42 and projecting outward from the exterior face 32 of the shell 12 by about ⅛". The tab 42 includes two notches 43, both essentially parallel to the lip 44, one on either side of the aperture 18.

The plate 14 has a width "pw"of approximately 3", a length "pl"of about 4½", rounded edges, and flat surfaces on the front and rear faces 20, 22. The attachment pins 24, 24' project from the plate 14 by about ½" along an axis "x". Each pin 24, 24' further includes a thumb 25, 25', respectively, measuring about ⅛" in length. The plate 14 is secured to the shell 12 by the pins 24, 24' projecting through the apertures 18, 18', respectively.

The sponge 16 has a shape similar to the plate 14 but has a width of about 2¾", a length of about 4", and a thickness of about ¼". The sponge is impregnated with microencapsulated suntan lotion, and is attached to the plate 14 with pressure sensitive adhesive.

Figure 8:
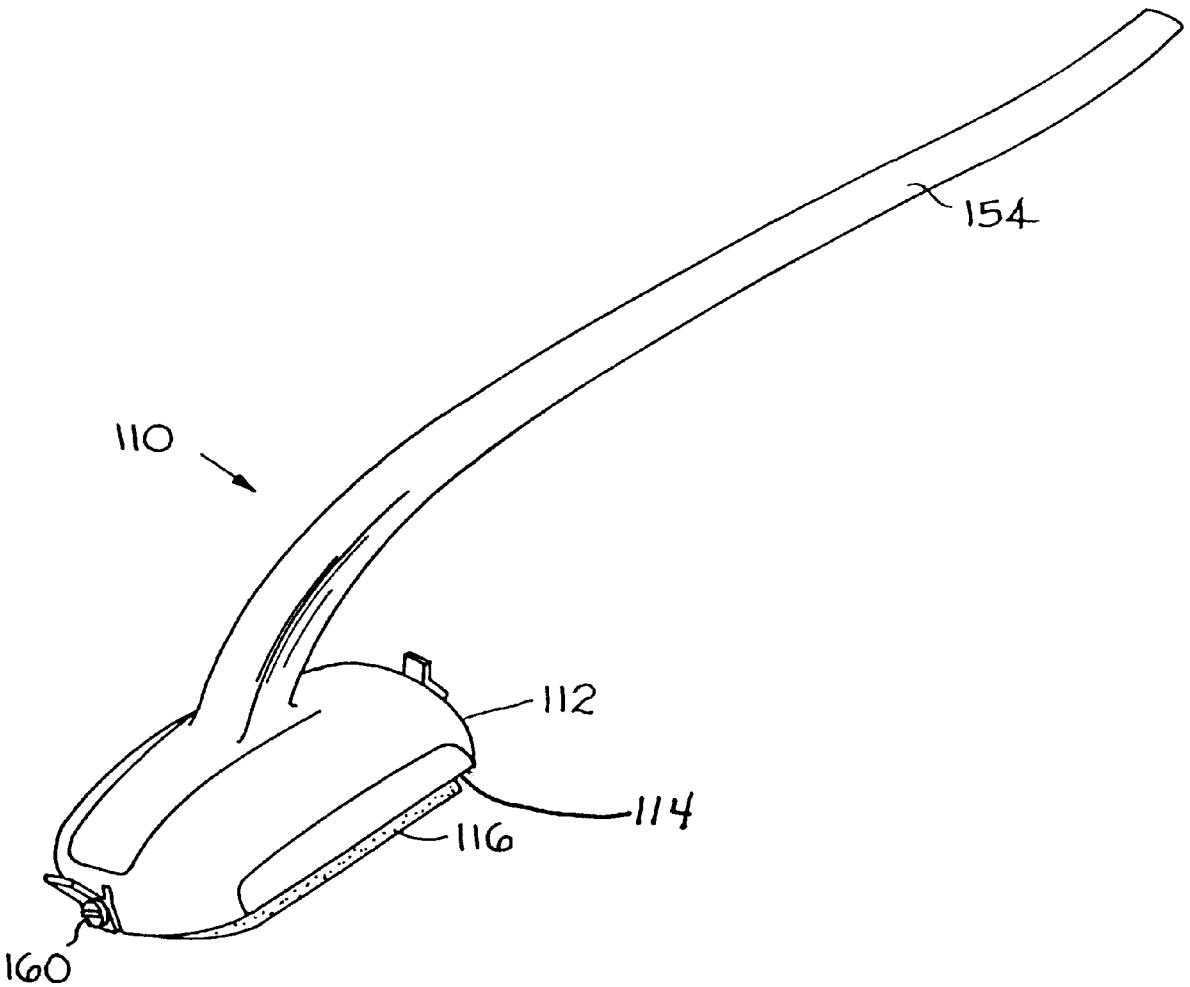
FIG. 8 is an alternative embodiment of a lotion application device made in accordance with the present invention.
Figure 9:
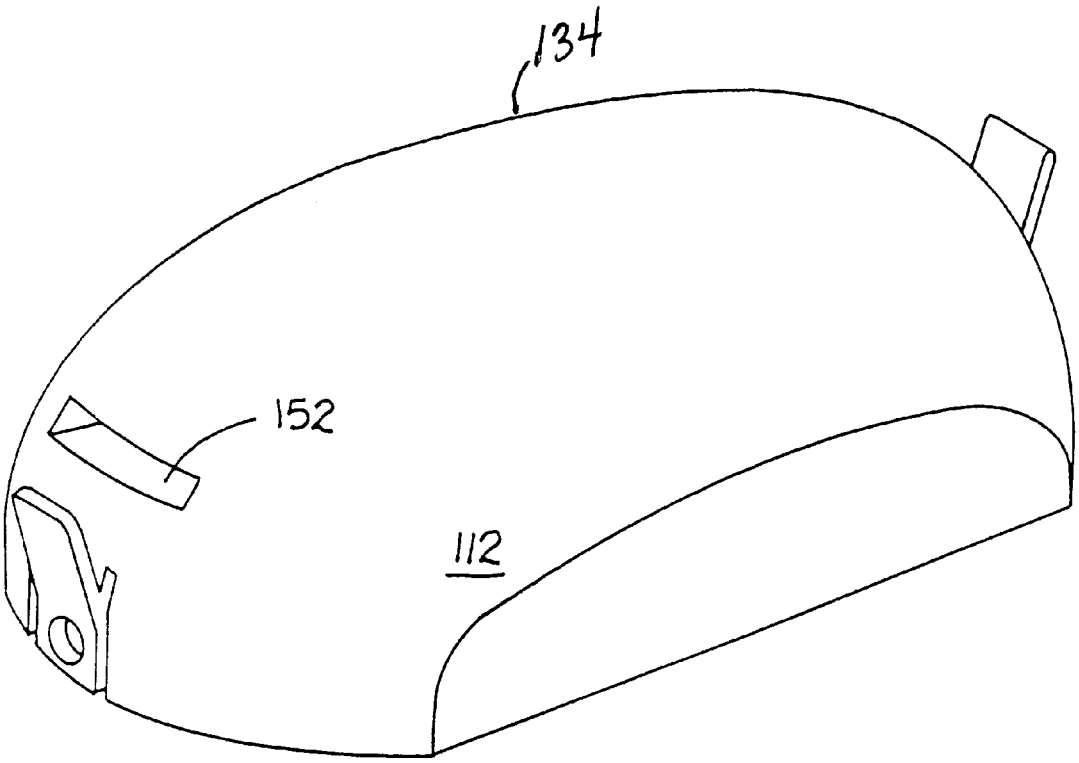
FIG. 9 is a top perspective view of the shell of the device of FIG. 8.
Figure 9A:
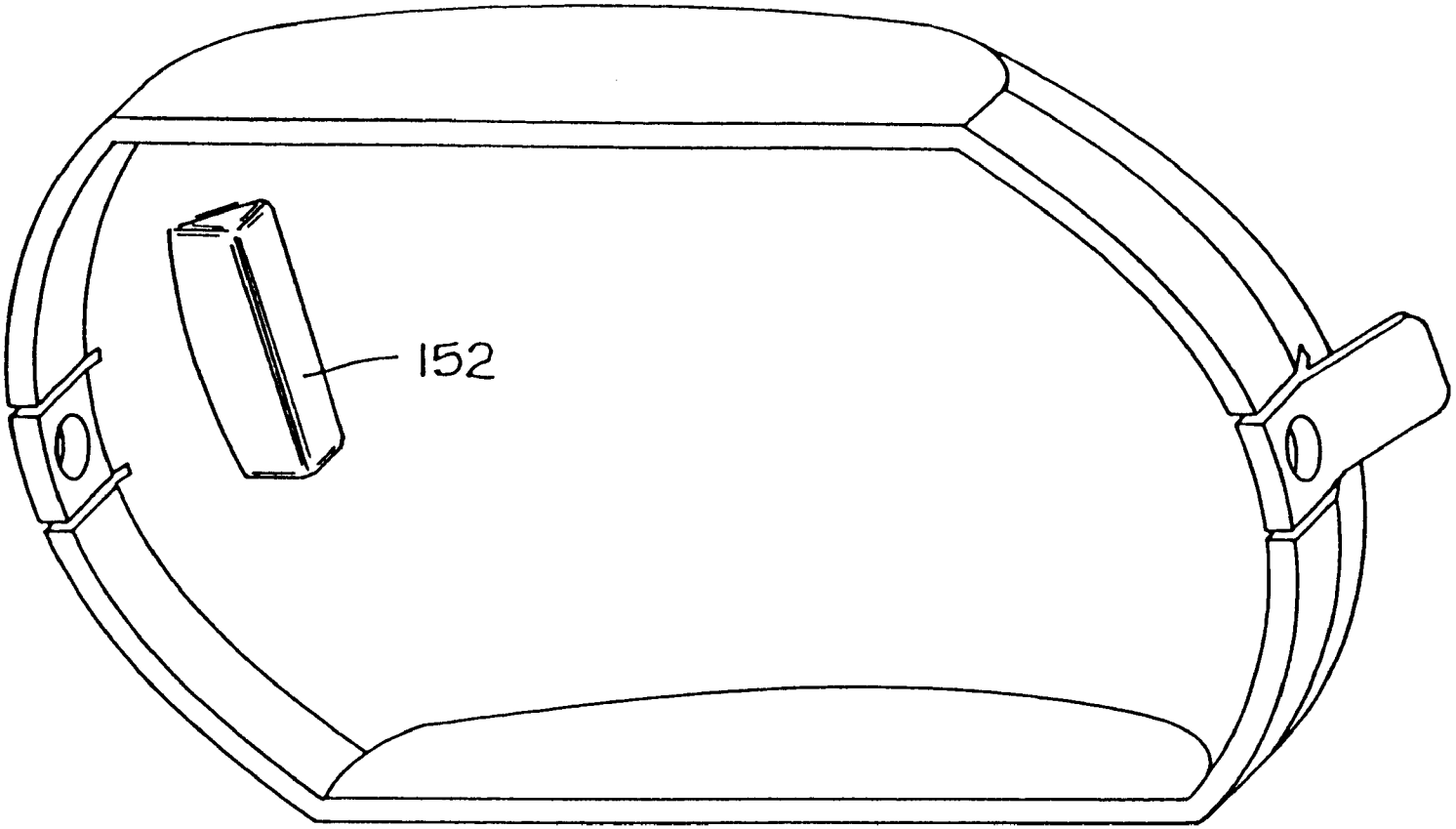
FIG. 9A is a bottom perspective view of the shell of the device of FIG. 8.
Figure 10:
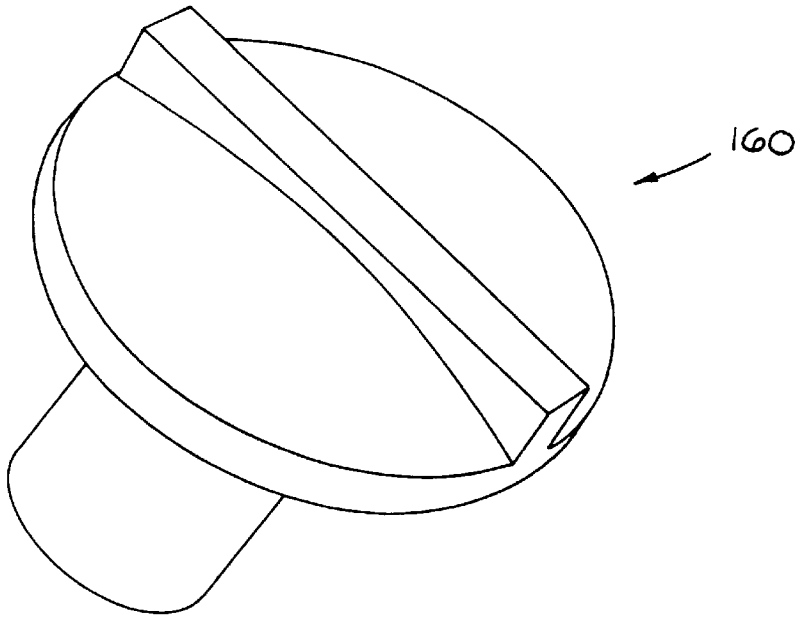
FIG. 10 is a side perspective view of the knob of the device of FIG. 8.
Figure 11:
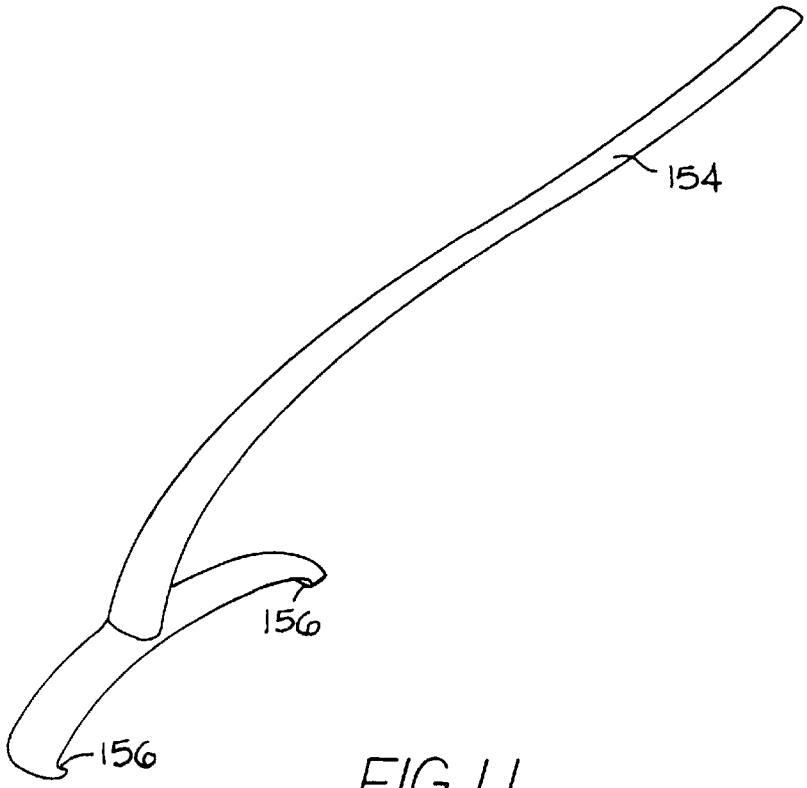
FIG. 11 is a side perspective view of the handle of the device of FIG. 8.
Figure 12:
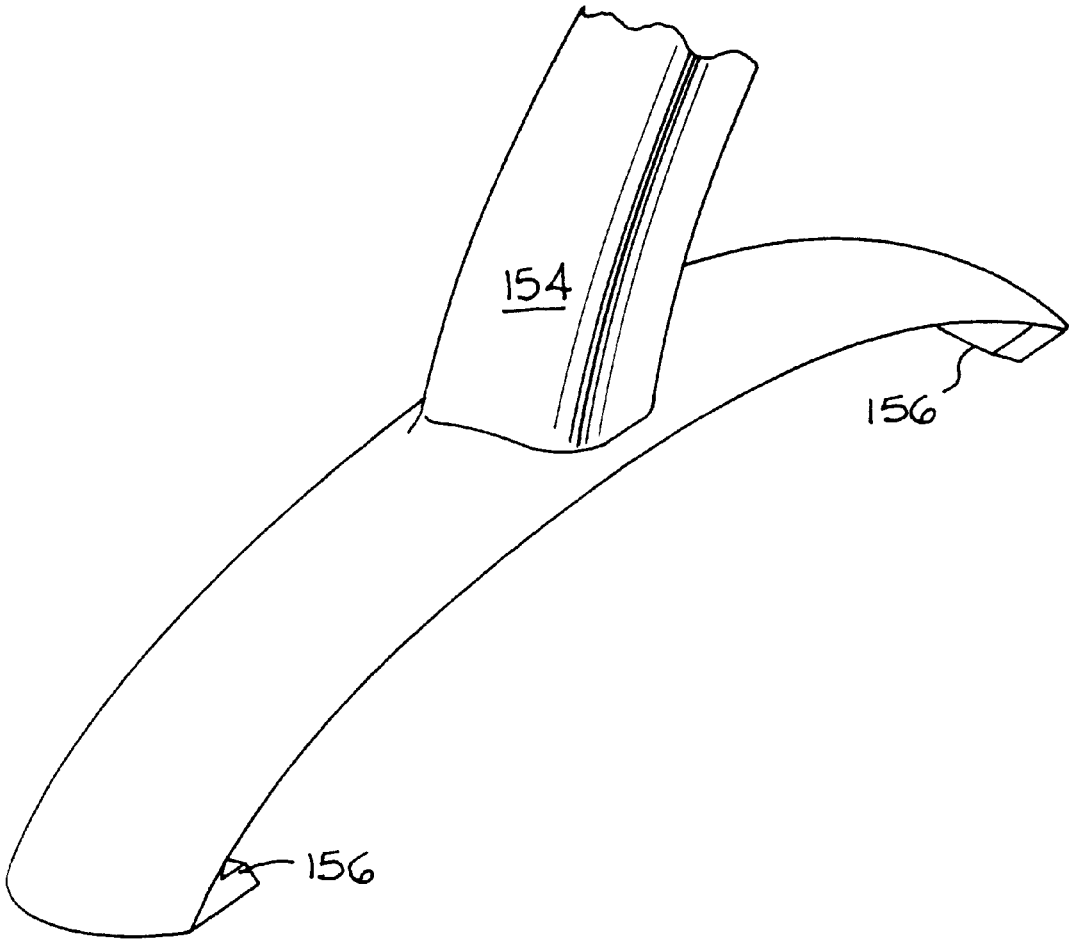
FIG. 12 is a side perspective view of the teeth of the handle of FIG. 11.

An alternative embodiment 110 of the lotion application device 10 is shown in FIGS. 8–12. As shown in FIG. 8, the lotion application device 110 may be used in conjunction with other attachments, such as a handle. The lotion applicator 110 shown in FIG. 8 is essentially identical to the applicator of FIG. 1 except that an ergonomically designed handle 154 (shown in FIGS. 11, 12) and an optional knob 160 (shown in FIG. 10) have been attached to the device 110, and the shell 112 has been modified as shown in FIGS. 9 and 9A to include latching indents 152 for accepting the teeth 156 of the handle 154. Similar to the device 10 of FIG. 1, the device 110 includes a rotatable plate 114 with an attached sponge 116. The plate 114 is mounted in the shell 112 in the same manner that plate 14 mounts to shell 12. The handle 154 can be fixedly attached to the shell 112 of the device 110, or it can be removable at the user's discretion. The handle 154 can have any of several known designs, such as a long handle projecting from the shell 112 (as shown in the FIGS. 8–12), or a strap-type handle extending across the exterior face 134 of the shell 112 (not shown). The shell 112 can also have shapes other than the shape shown in the FIGS. 1–12, with the plate 114 and sponge 116 being shaped to complement the shell 112 configuration.

It is understood that, in light of a reading of the foregoing description and drawings, those with ordinary skill in the art will be able to make changes and modifications to the present invention without departing from the spirit or scope of the invention, as defined herein.

What is claimed is:

1. An applicator for applying lotion to the skin comprising:

a. a shell, having a top and walls and defining a longitudinal axis, said walls having a pair of apertures positioned along the axis;

b. a plate, adapted to fit within the walls of said shell, and having a pair of pins extending from said plate such that the pins protrude through the apertures of said shell; and c. a sponge, attached to the face of said plate and selected by size and configuration so that when said sponge is attached to said plate and said plate is mounted in said shell, said plate can freely rotate about the longitudinal axis from a closed position, where said sponge is positioned between said shell and said plate, to an open position, where said plate is positioned between said shell and said sponge.

2. The applicator of claim 1 wherein said shell further includes a pair of moveable tabs, each tab formed by a pair of essentially parallel slits cut through the wall about equidistant from the aperture.

3. The applicator of claim 1 wherein said shell and said plate include coordinating structure that latch said plate in the open position.

4. The applicator of claim 1 wherein said sponge is impregnated with lotion.

5. The applicator of claim 1 further including a handle attached to the shell.

* * * * *